United States Patent [19]

Ouellette

[11] 4,423,660

[45] Jan. 3, 1984

[54] PARACHUTE RETAINER LATCHING MECHANISM

[75] Inventor: Charles W. Ouellette, Portsmouth, R.I.

[73] Assignee: Raytheon Company, Lexington, Mass.

[21] Appl. No.: 289,938

[22] Filed: Aug. 4, 1981

[51] Int. Cl.[3] ..... F41F 5/02

[52] U.S. Cl. ..... 89/1.5 R

[58] Field of Search ..... 102/387, 337-340, 102/348, 354; 89/1.5 R, 1.5 A, 1.5 D; 367/3, 4

[56] References Cited

U.S. PATENT DOCUMENTS

| | | | |
|---|---|---|---|
| 1,996,694 | 4/1935 | Wiley | 102/338 |
| 2,913,198 | 11/1959 | Bonbrake | 89/1.5 R |
| 4,164,887 | 8/1979 | Ouellette | 89/1.5 R |
| 4,209,151 | 6/1980 | Saunders | 102/387 |
| 4,263,835 | 4/1981 | Dragonuk | 89/1.5 R |

*Primary Examiner*—Charles T. Jordan

*Attorney, Agent, or Firm*—Martin M. Santa; Richard M. Sharkansky; Joseph D. Pannone

[57] ABSTRACT

A latching mechanism for retaining the cover of the compartment of a sonobuoy containing a parachute is described. The latching mechanism, when in a position which prevents the deployment of the parachute, extends beyond the periphery of the sonobuoy launching tube and thus prevents insertion of the sonobuoy into the launching tube. The latching mechanism must be moved to a position which releases the cover before it allows insertion of the sonobuoy into the launching tube thereby insuring deployment of the parachute after the sonobuoy has been ejected from the launching tube. The latching mechanism is a planar structure rotatably connected to the cover and rotates in a plane parallel to that of the plane of the cover. The resulting latching mechanism may be applied to sonobuoys without the necessity for modifying the launching tube structure used for prior art sonobuoys.

8 Claims, 5 Drawing Figures

PARACHUTE RETAINER LATCHING MECHANISM

BACKGROUND OF THE INVENTION

This invention relates to parachute retaining mechanisms for use with aircraft launched sonobuoys and relates particularly to an improved parachute release mechanism having a latch for releasably retaining the parachute and which prevents the premature release of the sonobuoy parachute.

To stabilize in-flight trajectories and to decelerate the speed to an acceptable water impact/entry velocity, most aircraft launched sonobuoys utilize a parachute which is stowed in a compartment provided at one end of the sonobuoy. Prior to insertion in the aircraft launcher, the operators are instructed to maintain a grip on the wind flap until the sonobuoy is placed in the launcher tube so that when the buoy is tilted for insertion in the tube, the wind flap will not pivot off and prematurely deploy the parachute. As has been the case in many aircraft drops, mishandling has lead to premature deployments of the parachutes. The operator in most instances in trying to repack the chute inadvertently tangles the shroud lines thereby resulting in an unstable air descent culminating in some instances with the sinking of the sonobuoy.

The wind flap is held in position against the sonobuoy by a tape in the prior art sonobuoy designs. The sonobuoy carries instructions for the aircraft technician to remove the tape prior to loading the sonobuoy into the launch tube. Should the technician forget to remove the tape, the flap will not function to deploy the parachute when the sonobuoy is launched. Also, occasionally in removing the tape the technician will inadvertently pull the wind flap completely off the sonobuoy which will require repacking the chute with possible adverse consequences as recited previously.

SUMMARY OF THE INVENTION

It is therefore an object of this invention to provide a latching mechanism whereby the wind flap is secured to the sonobuoy in such a manner that it is impossible to insert the sonobuoy container into the launching tube without first releasing the wind flap. The latching mechanism is also adapted to allow the wind flap to be placed in an operable condition without exerting forces on the wind flap which may inadvertently deploy the parachute. These and other objects of the invention are attained in a preferred embodiment by modifying the prior art structure by the addition of a latch pivotally attached to a sonobuoy cover over the parachute compartment and adapted to latch into the prior art guard rings of the sonobuoy to secure the cover to the sonobuoy. It is a feature of the invention that the latch mechanism may be incorporated into existing sonobuoys with a minimum of modification of the existing design and without change in form or fit of the sonobuoy; and that the use of a sonobuoy fitted with a latching mechanism of this invention is compatible with existing sonobouy launching devices.

BRIEF DESCRIPTION OF THE DRAWINGS

The foregoing objects and other features of the invention are explained in the following description taken in conjunction with the accompanying drawings wherein.

DETAILED DESCRIPTION OF THE INVENTION

Figure 1:
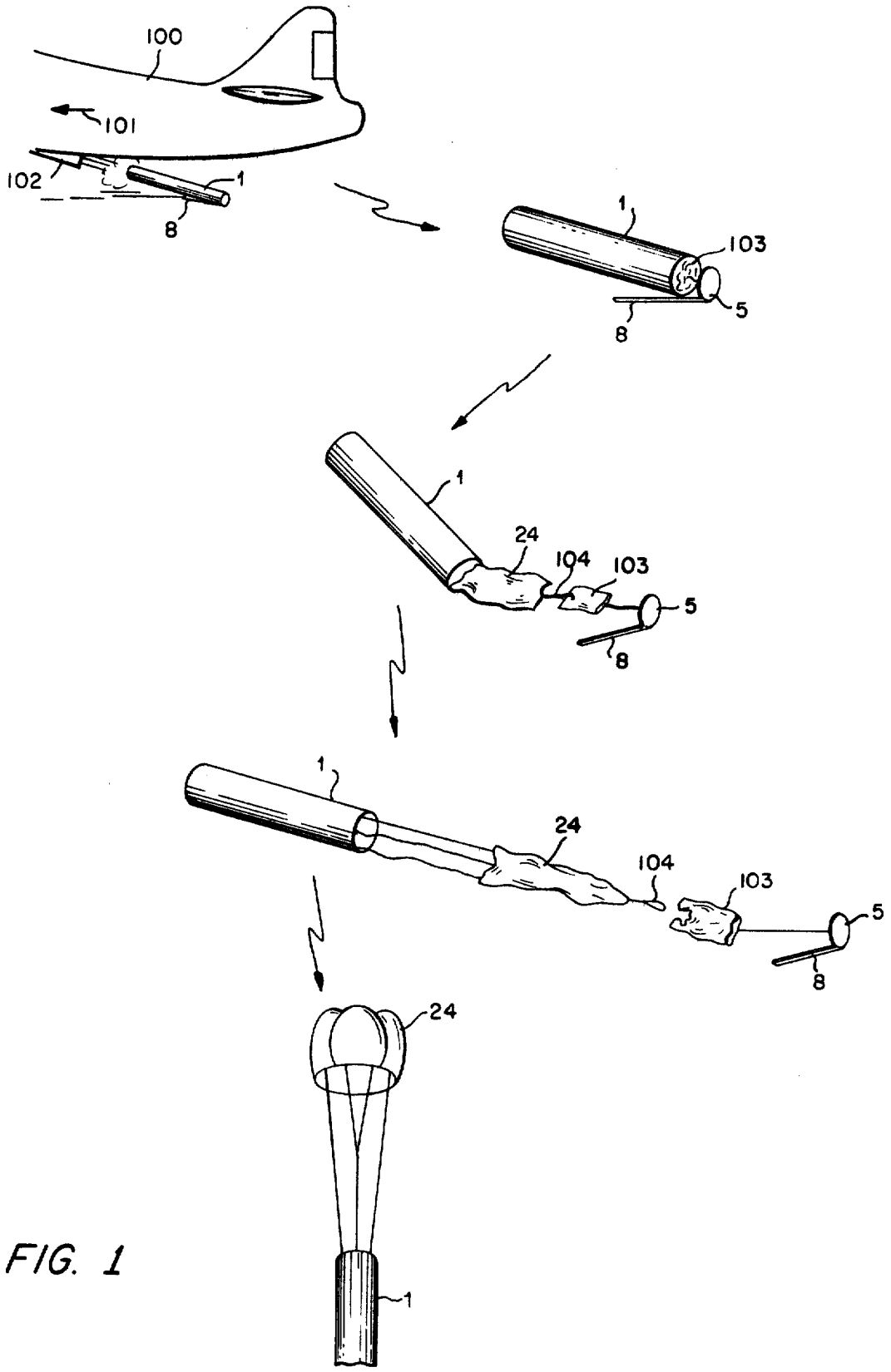
FIG. 1 is a stylized pictorial view of the manner in which a sonobuoy is ejected from an aircraft for a controlled descent to the water.

FIG. 1 shows the successive steps in the launching of a sonobuoy with a parachute for a controlled descent into water. An aircraft 100 flying in the direction of arrow 101 ejects sonobuoy 1 through a launching tube 102 such that the sonobuoy wind flap 8 is in a direction in which the relative wind velocity causes the wind flap to remove the retainer 5 from the sonobuoy 1. This action causes the cover 5 to start to pull on the plastic parachute bag 103 which is attached to and partially covers the parachute 24. The tether 104 attached to the plastic bag 103 pulls the parachute 24 from its stowage area within the sonobuoy 1. The bag 103 tears free of the tether 104 after the parachute has been pulled free of the sonobuoy after which the parachute becomes fully inflated and causes the sonobuoy 1 to descend at a controlled rate of descent into the water.

Figure 2:
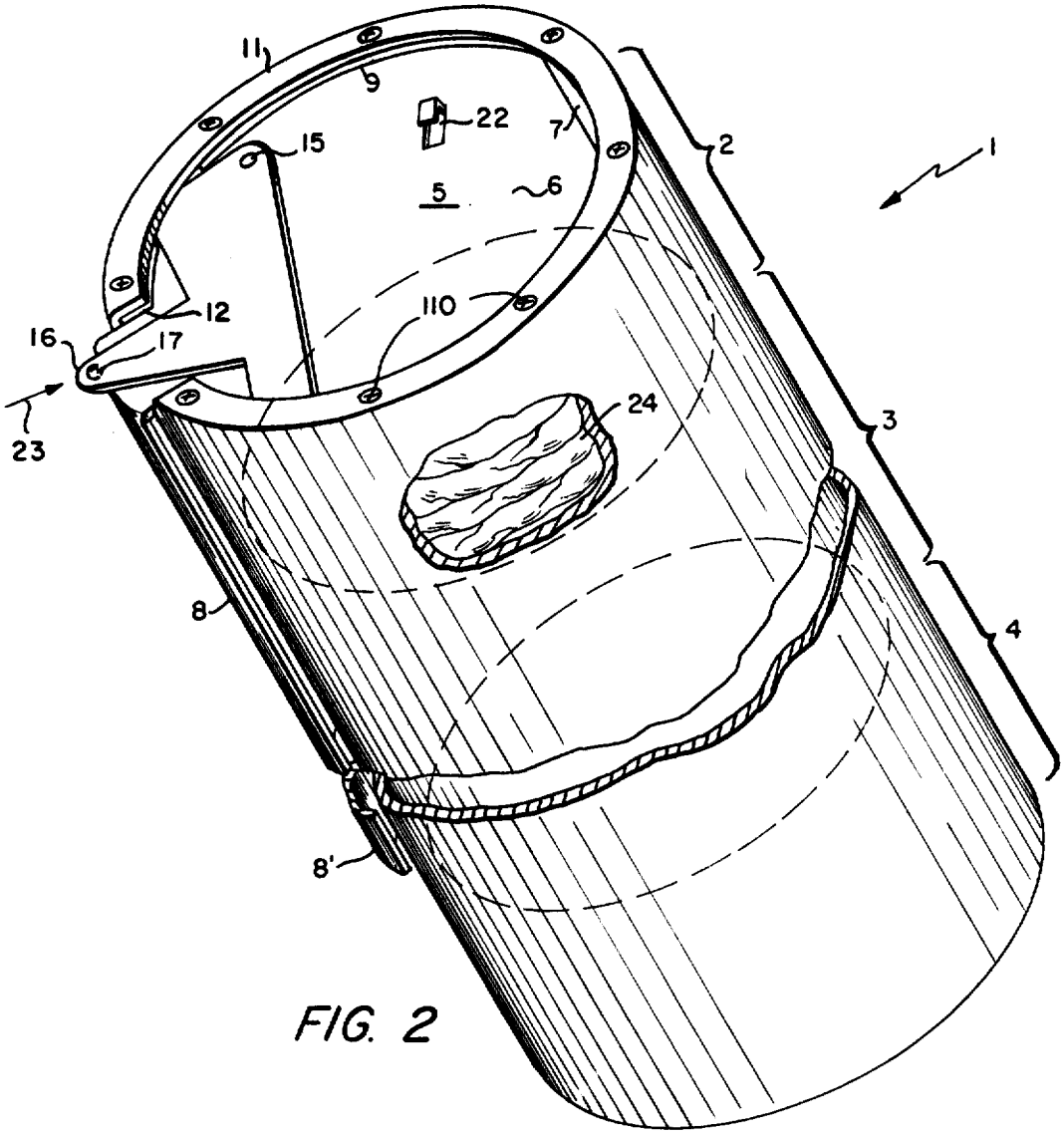
FIG. 2 is an isometric view of a sonobuoy showing the latching mechanism of this invention and in partial cross-section showing the parachute contained within a compartment of the sonobuoy.
Figure 3:
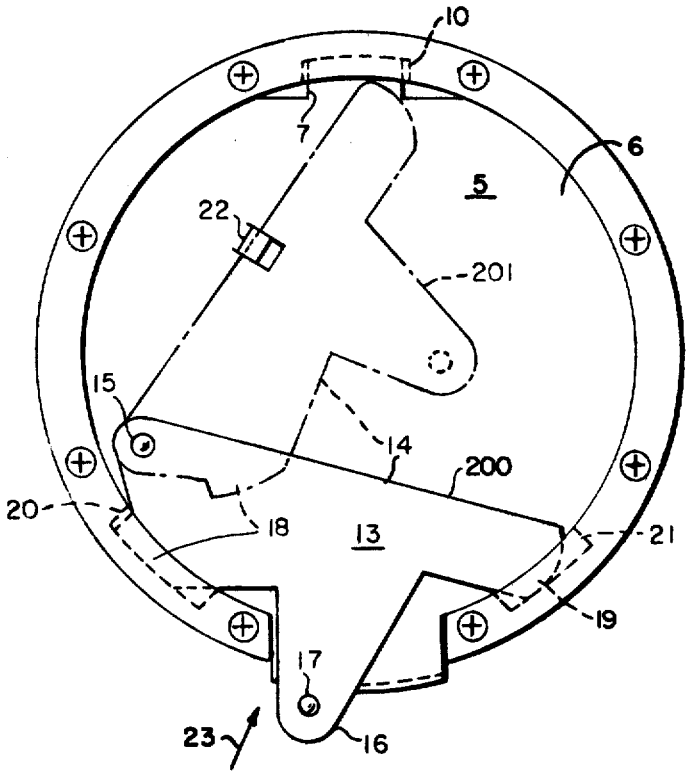
FIG. 3 is a top view of the sonobuoy showing the latching mechanism of this invention.

A sonobuoy constructed in accordance with this invention is shown in the isometric and top views of FIGS. 2 and 3, respectively. The sonobuoy 1 comprises a parachute compartment 2, a float compartment 3, and an electronics and sensor compartment 4 as in the prior art. The parachute retainer 5 comprises a circular cover portion 6, a tab 7 and a wind flap 8 as in the prior art. A slotted ring 9 has a slot 10 into which the tab 7 fits and slots 12, 20 and 21. The slotted ring 9 is secured to the end of the sonobuoy 1 by screws 110 and a ring 11 which has only one opening coincident with the corresponding slot 12 of the ring 9. The slot 12 receives that portion of the retainer 5 which connects the wind flap 8 to the circular cover 6. The wind flap end 8' is spaced from the sonobuoy 1 a sufficient distance so that when the sonobuoy 1 is pneumatically ejected from an aircraft, the velocity of the sonobuoy relative to the air provides sufficient force on flap 8 to remove the retainer 5 from the end of the sonobuoy by disengaging the tab 7. The apparent wind force causes the retainer 5 to unfurl the parachute 24 to which it is attached and which is contained in the parachute compartment 2. The above described parachute retainer 5 and its mode of operation in causing deployment of the sonobuoy parachute 24 as depicted in FIG. 1 constitute art prior to this invention.

The latch mechanism 13 of this invention comprises a lever 14 pivotally attached to the cover 6 by the pivot 15. The lever 14 has ends 18, 19 which engage slots 20, 21, respectively, of the slotted ring 9 when the lever mechanism 13 is in the "secured" position 200 shown in FIG. 3. When lever 14 is in the secured position, the wind flap 8 and cover 6 of retainer 5 are prevented from rotating by retaining ring 9 engaging lever ends 18, 19 about the tab 7 to release parachute 24. The lever 14 has a lever arm 16 which extends beyond the periphery of the sonobuoy 1 when the latch mechanism 13 is in the "secured" position 200 shown in FIG. 3. Since the diameter of the launching tube 40 of FIG. 4 contained in the aircraft 100 is only slightly larger than the diameter of the sonobuoy 1, the projection of the lever arm 16 beyond the periphery of the sonobuoy prevents the insertion of the sonobuoy 1 into the launching tube 40 when the latching mechanism 13 is in the secured position. A dimple 17 projecting on the underside of the lever arm 16 prevents rotation of the latch mechanism 13 about the pivot 3 unless a reasonable amount of force is applied to the lever arm 16 along direction arrow 23 thereby preventing the latch from inadvertently rotating to the "stowed" position 201 shown in FIG. 3.

In operation, the sonobuoy 1 is prepared for ejection from the aircraft by first removing a tape (not shown) which secures the wind flap 8 to the sonobuoy as in the prior art. The tape is not actually required in the embodiment of this invention because the latch mechanism 13 in the "secured" position will prevent accidental removal of the cover 6. The next step in preparing the sonobuoy for launching is to rotate the lever 14 about its pivot point 15 from the "secured" position to the "stowed" position 201 as shown in FIG. 3. The lever 14 in its stowed position 201 is kept in that position by dimple 17 in contact with cover 6 and by the projection 22 of cover 6 with which it makes frictional contact. When the lever is in the position 201, the ends 18, 19 have been removed from the slots 20, 21, respectively, and the wind flap 8 is rotatable about the tab 7 for removal of the parachute. When the latching lever 14 is in the position 201 the sonobuoy 1 is in condition for insertion into the launching tube 40 and launched in the same manner as prior art sonobuoys. Thus, the latching mechanism 13 results in a physical configuration of the sonobuoy and operational procedure for launching which is not significantly different from that of the prior art and allows prior art launching tubes to be used without modification with the improved latching mechanism of this invention.

Figure 4:
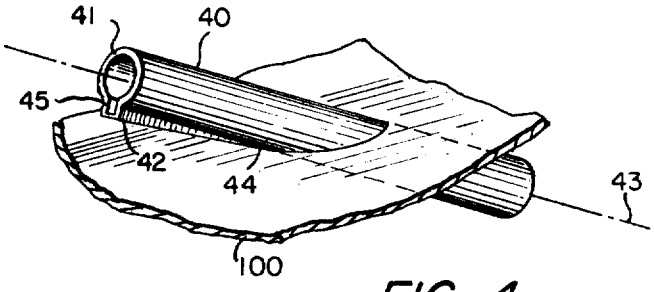
FIG. 4 shows a modified form of launching tube.

Another feature of this invention is that the latching mechanism 13 will allow a launching procedure for the sonobuoy which prevents the premature deployment of the parachute because of mishandling by the operator during loading into the launching tube. In this modified method for launching of the sonobuoy 1, the launching tube 40 must be slightly modified from that of the prior art by the addition of a longitudinal rib 42 radially extending with respect to its generally cylindrical form 41 as shown in FIG. 4. The opening 45 is large enough to allow insertion of the portion of the lever arm 16 which extends beyond the periphery of the sonobuoy 1 in its secured position 200. The radial extent of the rib 42 gradually decreases along the length of the launching tube 40 until at some region 44 along the tube the launching tube becomes circular.

Figure 5:
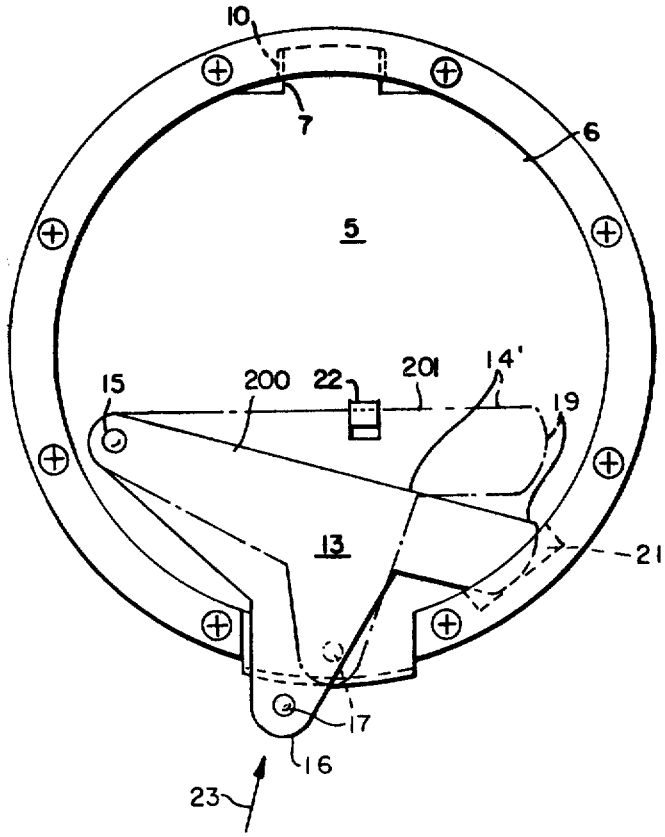
FIG. 5 shows the top view of a sonobuoy with a modified embodiment of the latching mechanism of this invention.

In operation, the sonobuoy with its latching mechanism 13 in its secured position 200 is inserted latching mechanism end first into the launching tube 40. The sonobuoy slides into the tube 40 and causes a force to be exerted upon the end portion of lever arm 16 in the direction of arrow 23 by the gradually decreasing radial extent of the rib 42. At the region 44 where the rib merges with the tube, the lever arm 16 will be substantially flush with the outer circumference of the sonobuoy 1 as shown in "stowed" position 201 in FIG. 5. The end 19 of lever 14' will then be clear of the slot 21 and the wind flap 8 will be in condition for rotating about the tab 7 when the sonobuoy exits the launching tube 40. Because of the relatively small radial movement of the lever arm 16, only one lever end 19 is shown in FIG. 5. The embodiment of FIG. 3 would also be suitable for stowing by rib 42 if the penetration of end 18 into slot 20 is such that end 18 clears slot 20 when lever 14 is in its stowed position 201. The arm end corresponding to that of end 18 of FIG. 3 is omitted in the alternate embodiment of FIG. 5 because the limited radial movement of lever arm 16 will produce only a small radial movement of that portion of lever 14' since that portion of the lever is nearer the pivot 15.

The lever 14' when in its "stowed" position has its dimple 17 in frictional contact with the cover 6 in order that it not fall back into its "secured" position when the lever-mechanism-end of the sonobuoy exits the launching tube thereby preventing the parachute from deploying.

Having described a preferred embodiment of the invention it will now be apparent to one of skill in the art that other embodiments incorporating its concept may be used. It is believed therefore that this invention should not be restricted to the disclosed embodiment but rather should be limited only by the spirit and scope of the appended claims.

I claim:

1. A sonobuoy container adapted to be inserted into a launching tube comprising:

a container having an opening to its interior at one end of said container;

a cover for said end opening;

a latch mechanism adapted to releasably secure said cover to said container end;

said latch mechanism, when in position to secure said cover, comprising means for preventing the insertion of said container into said launching tube;

said latch mechanism, when in position to release said cover, allowing the insertion of said container into said launching tube.

2. The apparatus of claim 1 wherein said means for preventing insertion comprises a lever arm which extends beyond the periphery of said container.

3. The apparatus of claim 1 wherein said latch mechanism comprises:

a lever arm rotatably attached to said cover;

a lever rigidly connected to said lever arm;

at least one slot for receiving the end of said lever located at the periphery of the end opening of said container;

said lever end being contained within said slot when said lever arm is in a position where it extends beyond the periphery of the container;

said lever end being removed from said slot when said lever arm is in a position where it is within the periphery of the container;

said cover having a tab, which is within a different slot at the periphery of said container, about which said cover rotates as it is released from said container.

4. The apparatus of claim 1 wherein said latch mechanism is adapted to engage with a projection from said cover to maintain the latch mechanism in position to release said cover.

5. A container adapted to be inserted into a holder comprising:

an opening in one end of said container;

a cover for said opening;

a latch mechanism adapted to releasably secure said cover to said container;

said latch mechanism preventing the insertion of said container into said holder when said latch mechanism is in a position which secures said cover to said container;

said latch mechanism allowing the insertion of said container into said holder when said latch mechanism is in a position in which said cover is removable.

6. A sonobuoy parachute retainer comprising:

a cylindrical sonobuoy comprising a container having a compartment at one end of said sonobuoy for housing a parachute;

said compartment having an opening to allow the parachute to exit said compartment;

a cover for said opening;

a latch rotatably attached to said cover and having a lever arm which extends beyond the periphery of said cylindrical sonobuoy when said cover is fastened to said sonobuoy by said latch to cover said opening;

said latch releasing said cover from said sonobuoy when rotated sufficiently to cause said lever arm to not extend beyond the periphery of the sonobuoy.

7. The apparatus of claim 6 wherein said latch comprises:

said lever arm and attached second lever both of which lie in a plane parallel to the plane of said cover;

said latch rotatably connected to said cover to rotate in a plane parallel to said cover plane.

8. The apparatus of claim 6 wherein said sonobuoy is cylindrical and said opening is in one end of said cylinder.

* * * * *